United States Patent [19]

Rosenquist et al.

[11] Patent Number: 4,464,913

[45] Date of Patent: Aug. 14, 1984

[54] KNITTING MACHINE CONTROL SYSTEM

[75] Inventors: Joel C. Rosenquist, Kernersville; Kenneth J. Thompson, Lexington; Wayne G. Foster, Advance, all of N.C.

[73] Assignee: Consolidated Foods Corporation, Winston-Salem, N.C.

[21] Appl. No.: 457,286

[22] Filed: Jan. 12, 1983

[51] Int. Cl.[3] ..... D04B 35/20

[52] U.S. Cl. ..... 66/166

[58] Field of Search ..... 66/157, 163, 166; 139/348

[56] References Cited

U.S. PATENT DOCUMENTS

| | | | |
|---|---|---|---|
| 2,790,602 | 4/1957 | Jeppson | 66/163 UX |
| 2,936,602 | 5/1960 | Blackburn et al. | 66/166 |
| 3,046,767 | 7/1962 | Nickell | 66/166 |
| 3,055,200 | 9/1962 | Meiners et al. | 66/166 |
| 3,065,615 | 11/1962 | Abrams | 66/166 |
| 3,116,621 | 1/1964 | Klein et al. | 66/166 |
| 3,345,835 | 10/1967 | Nickell et al. | 66/166 |
| 3,379,037 | 4/1968 | Antonevich | 66/163 |
| 3,409,779 | 11/1968 | Fertig | 66/166 X |
| 3,584,225 | 6/1971 | Lindeman et al. | 166/163 X |
| 3,790,761 | 2/1974 | Crabtree | 235/92 PD |
| 3,858,415 | 1/1975 | Wilson et al. | 66/86 A |
| 3,938,119 | 2/1976 | Schwartz | 66/163 X |
| 3,995,450 | 12/1976 | Rozett | 66/157 X |
| 4,027,982 | 6/1977 | Ohishi | 66/157 X |
| 4,366,681 | 1/1983 | Homocky et al. | 66/15 T X |

FOREIGN PATENT DOCUMENTS

| | | | |
|---|---|---|---|
| 3030006 | 3/1982 | Fed. Rep. of Germany | 66/166 |

*Primary Examiner*—Wm. Carter Reynolds

*Attorney, Agent, or Firm*—Charles Y. Lackey; William S. Burden

[57] ABSTRACT

A rundown detector system for controlling operation of the cylinder of a circular knitting machine includes a photoelectric circuit, including fiber optic means and a sensor for sensing predetermined extended periods of low reflected light level and emitting signals to a logic circuit. The logic circuit includes a timer and counting mechanism for stopping rotation of the machine cylinder if a predetermined number of signals are emitted to the logic circuit within a predetermined time period. The timer mechanism also prevents stopping of the machine cylinder, upon start-up of the machine, until a predetermined amount of knit fabric absent of defects has moved past the sensor.

9 Claims, 6 Drawing Figures

KNITTING MACHINE CONTROL SYSTEM

BACKGROUND, BRIEF SUMMARY AND OBJECTS OF THE INVENTION

This invention relates to a detector system for knitting machines and more particularly to sensor employed in manufacturing operations to detect defects in knitting fabric.

There is a variety of devices available for use on circular knitting machines to reduce the occurrence of fabric defects such as yarn breaks, holes in the fabric, runs in the fabric, etc.

Normally the instruments for assuring better quality knitted fabric consist of devices which sense yarn breakage in its passage from a yarn supply to the knitting elements of the circular knitting machine, and devices for sensing fabric condition between the knitting elements and the fabric take-down assembly.

One of the more commonly used detectors is an electrical device for stopping operation of the knitting machine when a yarn breaks or runs out.

Devices for detecting holes and runs in fabric also are commonly used for automatically stopping operation of the machine. These may be in the form of mechanical fingers or electronic devices for optical scanning of the fabric to locate defects. However, as in the case of rundown detectors, the prior art forms have certain disadvantages. For example, such devices do not have the ability to detect good fabric from bad fabric. Sometimes in oiling the knitting machines, oil may cause streaks on the fabric, thus giving false signals of a run in the fabric. Once the machine has been restarted, the system of the present invention prevents the rundown detector from stopping the machine again until a prescribed amount of faultless fabric has been sensed by the rundown detector.

A primary object of the invention is the provision of a new and improved fault detection system for knitting machines.

Another object of the invention is to provide a novel rundown detector which substantially eliminates the stopping of the machine due to false signals and deactivates the machine only in the event of an actual rundown defect in the fabric.

It is another object of the invention to provide a rundown detector which incorporates a fiber optic means and a floating head for sensing the condition of the fabric.

A further object of the invention is to provide a knitting machine incorporating a system for deactivating the machine upon detection of a rundown, a yarn break, or occurrence of an opening in the fabric.

Still another object of the invention is a fault detection system which is reliable in operation and which may be economically applied to existing knitting machines.

Other objects and advantages of the invention will become apparent when considered in view of the following detailed description.

DETAILED DESCRIPTION OF THE INVENTION

Figures 1, 4:
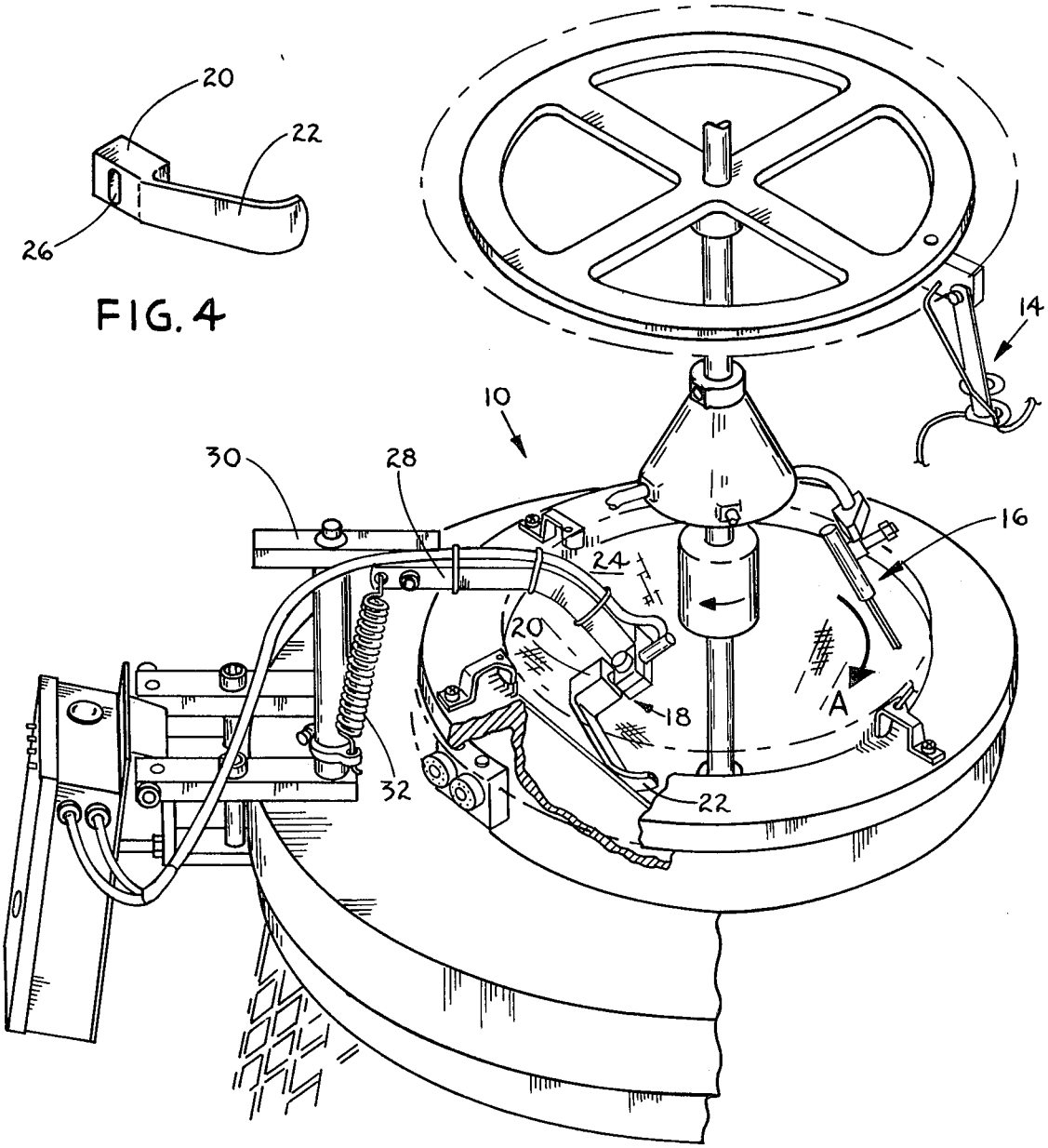
FIG. 1 is a fragmentary, perspective view of a conventional circular knitting machine having the fault detection system of the present invention applied thereto.
FIG. 4 is a perspective view of the sensor head of the rundown detector.
Figure 2:
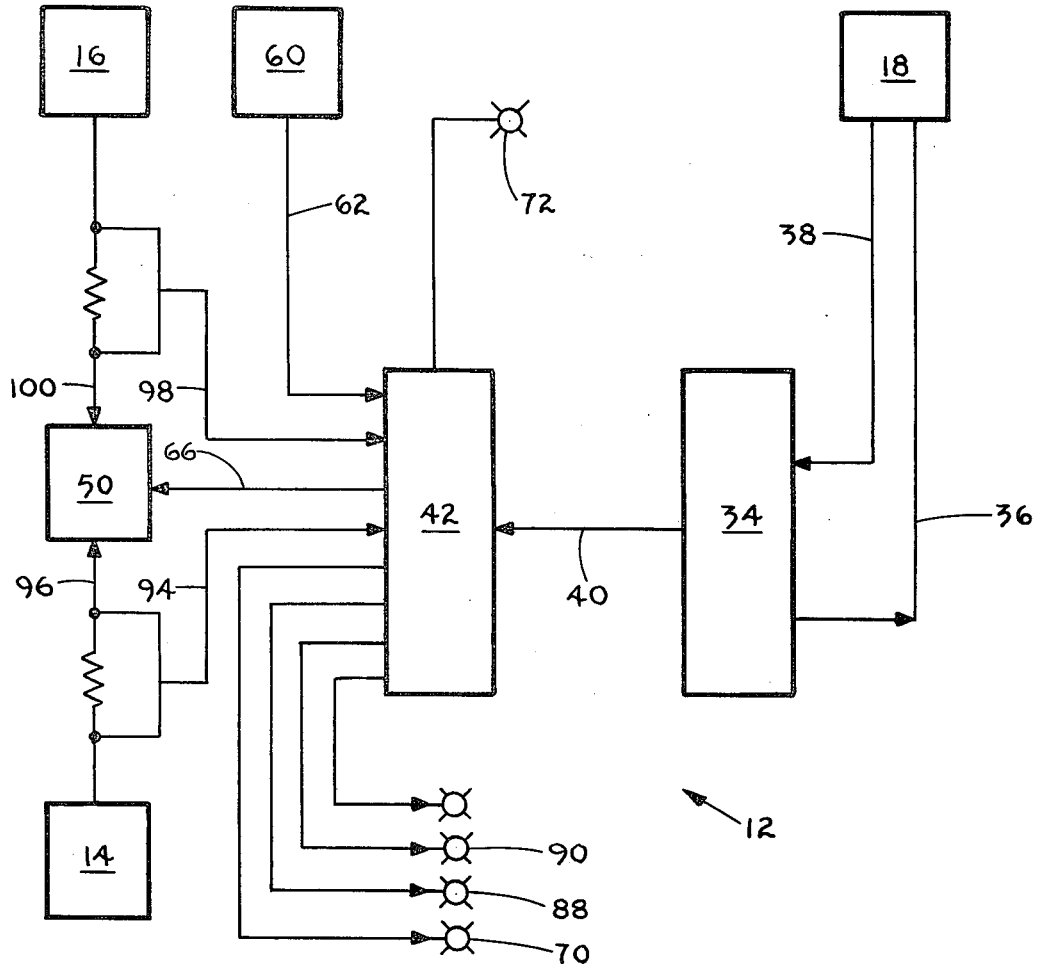
FIG. 2 is a schematic block diagram of the system including the circuitry for controlling the machine.

Referring to FIG. 1, a conventional circular knitting machine 10 having an electrical stop motion is provided with the fault detection system 12 (FIG. 2) of the present invention which includes various devices for reducing the occurrence of defects in the fabric being knit. The system includes a conventional yarn break or runout detector 14, a conventional mechanism 16 for detecting holes in the knit fabric or pressoffs, and a device 18 for detecting runs in the fabric.

The rundown detector 18 includes a floating sensor head 20, positioned at a selected point or location, having a guide member 22 which engages the inner portion of the knit tube, as shown by FIG. 1. Upon rotation of the knit fabric tube 24 in the direction of the arrow A, FIG. 1, the sensor head 20 is in contact with the fabric immediately below the knitting elements. The head 20 includes an elongated aperture 26, FIG. 4, which may be, for example, 1/16" wide and ½" long, and is secured to an arm 28 which, in turn, is pivotably supported upon a bracket 30. Spring 32 serves to provide a counterbalancing effect on the arm 28 and head 20 so that the head is in light, floating contact with the fabric 24.

The detector 18, which optically checks for continuous stitch formation, will not stop the machine 10 except when a rundown is sensed. As long as yarns forming the stiches are intact, light from a photoelectric amplifier circuit 34 is continuously transmitted along a fiber optic tube 36 and through the aperture 26 of the sensor head 20, in engagement with the rotating fabric tube 24, and is reflected off the knitted fabric and back to the photoelectric amplifier circuit 34 via the aperture 26 and the fiber optic tube 38. Alternating periods of relatively high and low reflected light levels are transmitted to the circuit 34 due to alternate peaks and valleys of the knit fabric. When a predetermined, extended period of low reflected light is detected by circuit 34 due to occurrence of a run, an output signal is generated and directed along line 40 to the logic circuit 42.

Figure 6:
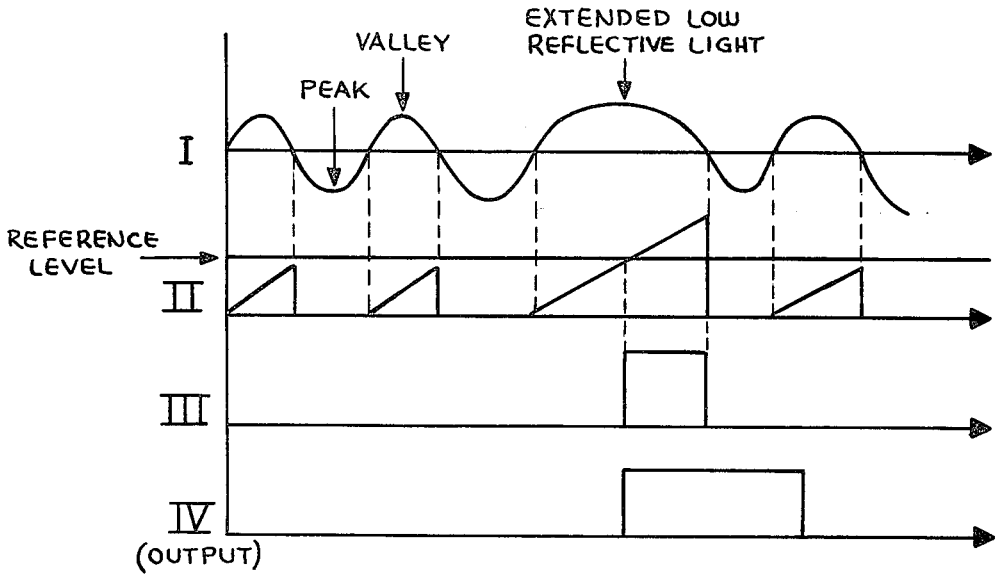
FIG. 6 is a diagram of voltage wave forms illustrating operation of the circuit of FIG. 5.
Figure 3:
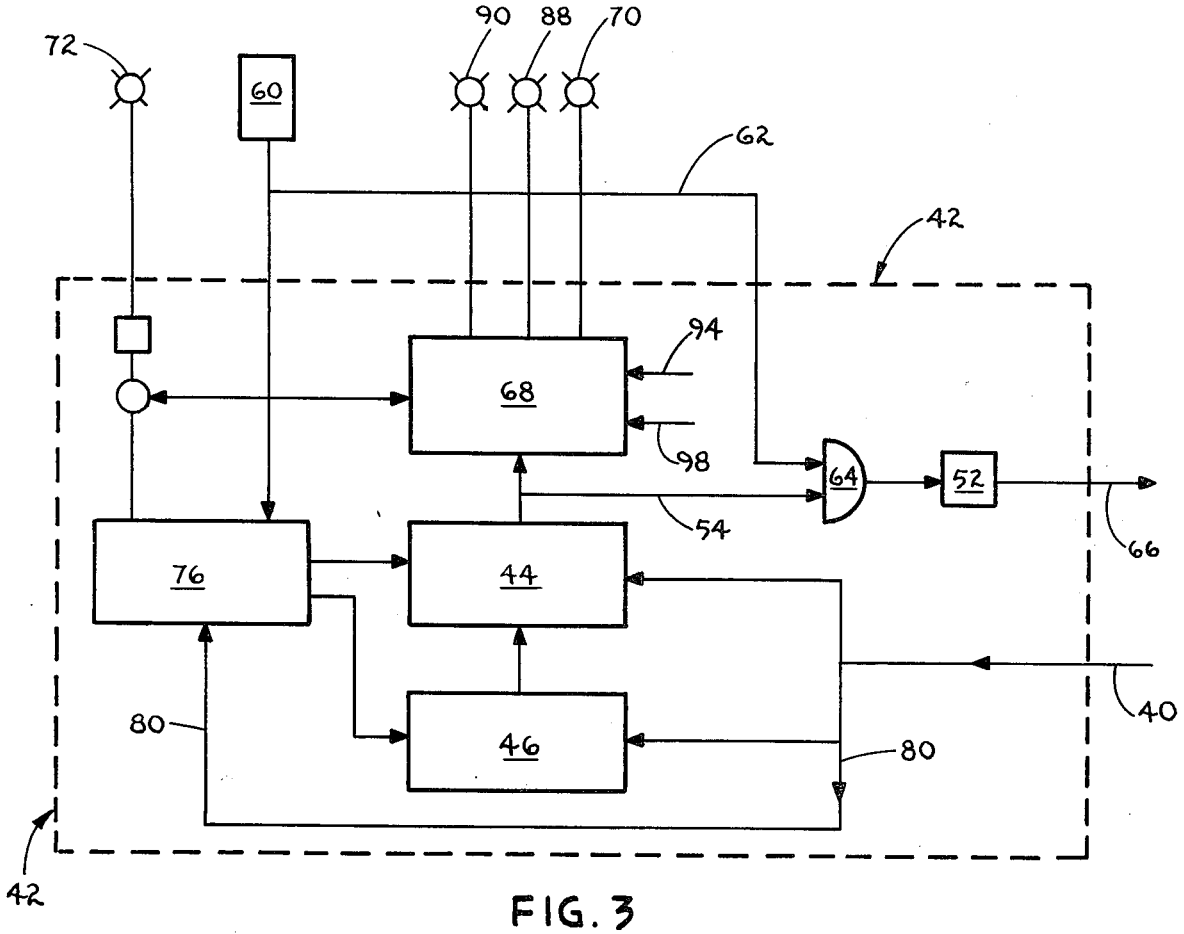
FIG. 3 is a block diagram of various components of the system including an enlarged schematic diagram of the logic circuitry of FIG. 2.
Figure 5:
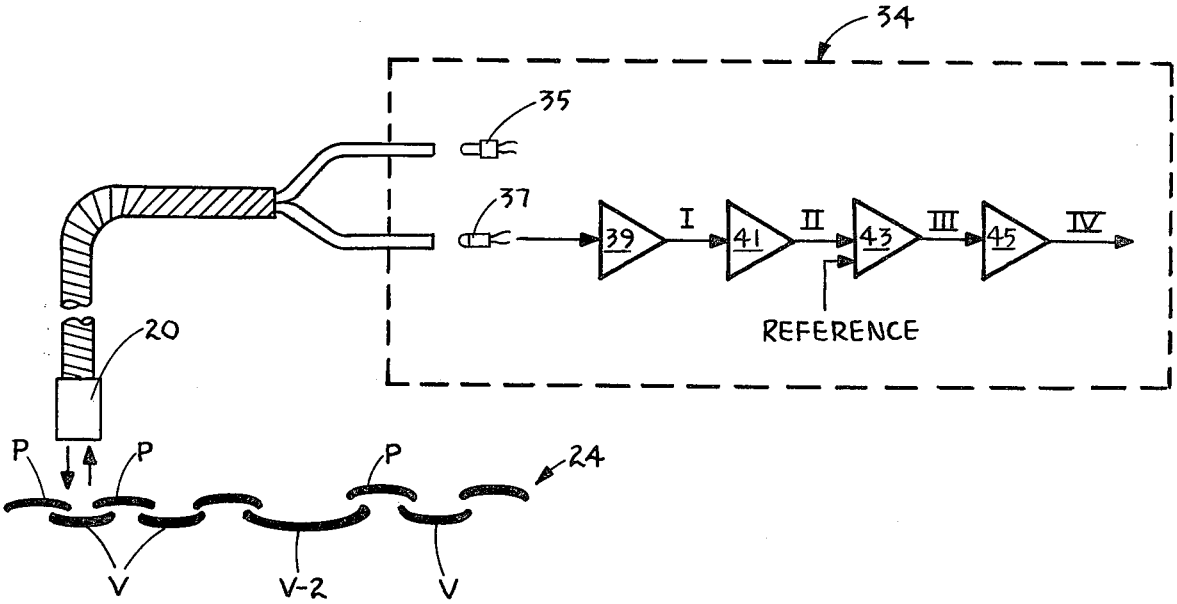
FIG. 5 is a schematic electrical diagram of various components of the photoelectric amplifier circuit.

Referrings to FIGS. 5 and 6, the photoelectric circuit 34 operates by sensing peaks P and valleys V in the surface texture of the knit fabric 24 and emitting a signal when the space between two adjacent peaks is longer than normal, as at V-2.

Light from the source 35 is conducted along fibers within a tube 36 and directed onto the moving fabric 24. A portion of the light is reflected from the cloth, directed along tube 38 and detected by a photocell 37. The signal is amplified in such a way that valleys in the fabric (relatively low reflected light) are represented by positive peaks in a voltage wave form at the output of amplifier 39. Peaks in the fabric (high reflected light) cause negative voltage valleys in the output waveform (I. of FIG. 6) of the amplifier.

The amplifier 39 is connected to a voltage integrator 41 which produces a "ramp" output (II. of FIG. 6). Since the ramp builds at a nearly linear slope rate, while the input voltage is positive, the maximum voltage of the ramp depends upon the length of time the input voltage is positive. The maximum ramp voltage, therefore, depends on the length or width of the valley in the fabric.

The integrator output feeds into a comparator 43 along with a fixed reference voltage to which the ramp voltage is compared. When the ramp voltage exceeds the reference voltage, caused by a rundown, the comparator provides an output which triggers a one-shot output 45.

The signal is fed simultaneously to a shift register 44 and a timer 46 which form part of the logic circuit. The timer 46 enables the shift register 44 to operate to count a predetermined number of additional signals generated along line 40 from the photoelectric circuit 34, one signal being generated each time the fault or defect in the fabric rotates past the sensor head 20. After the shift register receives a predetermined number of signals within a prescribed period determined by the timer 46 which is sufficient to determine that the fault being detected is a rundown, the knitting machine electric stop motion 50 is activated to stop the drive to cylinder of machine 10. If the prescribed number of signals is not received during the prescribed time period, the logic circuit 42 will reset itself without stopping the machine. For the stop motion 50 to stop the machine, a signal must be received from the shift register 44 through line 54 and a signal must be directed from switch 60 along the line 62 to the AND circuit 64. The switch 60 senses when the machine 10 is running. Whenever signals appear at the same time along lines 54 and 62 the AND circuit 64 produces an output signal which through triac 52 in line 66 activates the electric stop motion 50 either directly or indirectly to stop operation of the machine. The stop motion, when activated, deactivates the main motor, not shown, which drives the knitting machine.

When a signal from the shift register 44 is directed to the AND circuit 64, the latch 68, provided to store information, also activates the rundown indicator light 70 which signals to an operator the particular reason for the machine shutdown. The main warning light 72 also will be on indicating to an operator that the machine needs attention. If the machine is stopped by an operator, no indicator lights will be on.

After the operator has corrected the problem, and the machine restarted, rundown indicator light 70 will go off. However, the main warning light will remain on until the rundown detector 18 has "seen" a predetermined number of revolutions of faultless fabric 24. During this time the machine cannot be stopped due to signals generated by the photoelectric circuit 34.

Restarting of the machine activates a lockout timer 76 through switch 60. The lockout timer 76 is activated for a prescribed period of time which would permit a predetermined number of revolutions of the fabric tube 24 being knit, for example, five revolutions of the tube. If the rundown detector 18 does not sense a fault in the fabric during this time and the fabric is "verified" to be "good," the timer 76 will time out and the main warning light 72 will be turned off.

Occasionally when a machine has been stopped for oiling of various components, oil streaks will get onto the fabric which will give fault signals to the rundown detector 18 when the machine is restarted. Upon restarting the machine the lockout timer 76 also is activated. If, before timer 76 times out, the detector 18 senses an oil streak and a signal is emitted by the photoelectric circuit 34, the signal is directed along line 80 to restart the lockout timer 76. The lockout timer 76, which is also connected to the shift register 44 and timer 46, prevents the shift register from sending a signal to stop the motion until the timer 76 times out without receiving a signal from the photoelectric circuit 34. The timer 76 may stay on indefinitely as long as signals are generated by the circuit 34, before the timer 76 can time out. If the oil streaks move below the sensor head 20, and a signal is not received from circuit 34 before the timer 76 times out, the fabric is verified to be good and deactivation of the timer 76 turns off the warning light 72.

The yarn break detector 14, as shown schematically on FIG. 1, is of a conventional type. For example, the detector may include a spring biased guide arm for selectively activating a switch. The yarn tension normally maintains the arm in an inoperative position, and when the yarn breaks or runs out the arm is biased to operate a switch. While one detector 14 has been shown, it is to be understood that detectors may be provided for each yarn fed to the knitting elements.

Upon activation of a detector 14, a signal is sent simultaneously to the logic circuit 42 along line 94 and to the electric stop motion 50 aloong line 96, which stops the machine. The latch 68 of the logic circuit activates the yarn break indicator light 88 and the main warning light 72.

The hole detector mechanism 16, which is operated upon the occurrence of a hole or pressoff, also is of a conventional type. The detector may consist of a spring loaded plunger which normally engages the knit fabric tube. Upon the occurrence of a hole the plunger contacts metal at the back of the fabric tube which sends a signal simultaneously along line 98 to the logic circuit 42 and along line 100 to the electric stop motion 50 to stop the machine and activate warning line 72 and the hole detector light 90.

What is claimed is:

1. A system for controlling the operation of a circular knitting machine having a driven cylinder and an electrical stop motion for selectively deactivating the cylinder, including logic circuit means, a first detector means including a sensor head for sensing a defect in fabric being knit as the fabric moves past said sensor head, said detector means further including means for emitting a signal to said logic circuit means each time a fabric defect section moves past said sensor head, said logic circuit means including means for counting successive signals emitted by said first detector means within a prescribed time period and for emitting a signal to the knitting machine electrical stop motion upon counting a predetermined number of signals from said first detector means within a prescribed time period, said means for counting successive signals emitted from said first detector means within a prescribed time period and for emitting a signal to the knitting machine stop motion including a first timer and a shift register, said signal emitted by said detector means to said logic circuit means simultaneously activating said first timer for a predetermined time period and activating said shift register, said shift register emitting a signal to the knitting machine stop motion to stop the machine when said shift register receives a predetermined number of signals from said detector means before said first timer times out, said logic circuit means including a second timer, means activating said second timer upon starting of the knitting machine, said second timer coupled to said first timer and said shift register to prevent said shift register from emitting a signal to the machine electrical stop motion, until a predetermined amount of knit fabric absent of defects has moved past said sensor head.

2. A system as recited in claim 1, said first detector means further including means supporting said sensor head in floating engagement with said knit fabric tube at a location in close proximity to knitting elements of the knitting machine.

3. A system as recited in claim 2, said first detector means also including a photoelectric amplifier circuit and fiber optic means coupling said sensor head and said photoelectric amplifier circuit.

4. A system as recited in claim 1, said logic circuit means further including latch means for activating a signal to indicate that a fabric rundown has been detected.

5. A system as recited in claim 4, and further including second detector means for detecting when yarn directed to the knitting machine knitting element breaks or runs out, said second detector means emitting a signal to said knitting machine stop motion and to said latch means for activating a signal to indicate to the operator a yarn break.

6. A system as recited in claim 5, and further including third detector means for detecting the occurrence of a hole in the fabric, said third detector means emitting a signal to said knitting machine stop motion and to said latch means for activating a signal to indicate a hole or opening in the fabric.

7. A system as recited in claim 1, said first detector means including a light source, a photosensitive element, fiber optic means for transmitting light from said source to said sensor head and onto the contours of the fabric surface defined by yarns forming alternating peaks and valleys, and for transmitting alternating high and low levels of reflected light, corresponding to said peaks and valleys, from the fabric to said photosensitive element, and circuit means for sensing a predetermined extended period of low reflected light.

8. In a system for sensing and indicating defects in fabric being knit on a circular knitting machine provided with an electrical stop motion, said system including means for generating a signal responsive to the detection of a defect in a rotating fabric tube being knit as the fabric moves in a given direction past a given point, said signal generating means including a sensor head at said given point positioned in floating contact with said fabric tube as the tube is being knit, and fiber optic means for receiving signals from said signal generating means, said logic circuit means including means for sensing the concentration of signals and for activating the knitting machine electrical stop motion to stop the knitting machine upon receipt of a prescribed number of signals from said signal generating means in a predetermined time period, said logic circuit means further including means activated for a prescribed period of time upon restarting of the knitting machine for preventing activation of said electrical stop motion until a predetermined amount of knit fabric absent of defects has moved past said sensor head.

9. In a system for sensing and indicating defects in fabric being knit on a circular knitting machine provided with an electrical stop motion, said system including means for generating a signal responsive to the detection of a defect in a rotating fabric tube being knit as the fabric moves in a given direction past a given point, said signal generating means including a light source, a sensor head, circuit means having a photosensitive element, and optical fibers for transmitting light from said source to said sensing head and for transmitting light reflected by the fabric contours from said sensing head to said photosensitive element, said fabric contour defined by alternating peaks and valleys for reflecting high and low levels of light to said circuit means, said circuit means including means for distinguishing rapidly alternating high and low levels of light reflected from said fabric contour and for generating a signal when a predetermined time period is exceeded between adjacent high levels of reflected light, logic circuit means for receiving signals from said circuit means, said logic circuit means including means for sensing the concentration of signals received from said circuit means and for activating the knitting machine electrical stop motion to stop operation of the machine upon receipt of a prescribed number of signals within a predetermined time period, said logic circuit means further including timer means activated for a prescribed period of time upon restarting of the knitting machine for preventing activation of said electrical stop motion until a predetermined amount of knit fabric absent of defects has moved past said sensor head.

* * * * *

UNITED STATES PATENT OFFICE

CERTIFICATE OF CORRECTION

Patent No. 4,464,913 Dated August 14, 1984

Inventor(s) Joel C. Rosenquist, Kenneth J. Thompson, Wayne G. Foster

It is certified that error appears in the above-identified patent and that said Letters Patent are hereby corrected as shown below:

Column 6, line 5, insert ---coupled to said sensor head, logic circuit means--- before the word "for."

Signed and Sealed this

*Eighth* Day of *January 1985*

[SEAL]

*Attest:*

*Attesting Officer*

GERALD J. MOSSINGHOFF

*Commissioner of Patents and Trademarks*